US007172088B2

(12) United States Patent
McDade et al.

(10) Patent No.: US 7,172,088 B2
(45) Date of Patent: Feb. 6, 2007

(54) INSERT FOR A ROLLOUT TYPE WASTE CONTAINER AND WASTE CONTAINER ASSEMBLY

(75) Inventors: Clinton McDade, Charlotte, NC (US); Morris Marlow, Statesville, NC (US)

(73) Assignee: Schaefer Systems International, Inc., Charlotte, NC (US)

( * ) Notice: Subject to any disclaimer, the term of this patent is extended or adjusted under 35 U.S.C. 154(b) by 368 days.

(21) Appl. No.: 10/684,297

(22) Filed: Oct. 10, 2003

(65) Prior Publication Data

US 2004/0074913 A1 Apr. 22, 2004

Related U.S. Application Data

(60) Provisional application No. 60/418,382, filed on Oct. 15, 2002.

(51) Int. Cl.
*B65F 1/08* (2006.01)

(52) U.S. Cl. ..... 220/23.87; 220/908.1

(58) Field of Classification Search ..... None
See application file for complete search history.

(56) References Cited

U.S. PATENT DOCUMENTS 3,185,339 A * 5/1965 Fleming ..... 220/495.06
5,503,512 A 4/1996 Bayne
5,538,158 A * 7/1996 Prout et al. ..... 220/771
5,582,322 A 12/1996 Prout et al.
D398,120 S 9/1998 Rehrig et al.

OTHER PUBLICATIONS

AMERI-KART, Residential Waste Handling Systems from Ameri-Kart—Injection Molded MegaKart, Internet Website Pages, Oct. 2002, 2 pages, US.

Cascade Engineering Group, Meet Our Star Performers—Introducing Cascade Cart, Internet Website Page, 1 page, Grand Rapids, MI, US.

* cited by examiner

*Primary Examiner*—Stephen Castellano
(74) *Attorney, Agent, or Firm*—Adams Evans P.A.

(57) ABSTRACT

An insert bin for use with a rollout type waste container or cart. The insert bin limits the volume of refuse or recyclable material that a customer may deposit in the container. The insert bin is held in place within the interior of a waste cart without the use of separate mechanical components or a press fit. The insert bin instead takes advantage of the lift bar, which already exists on a waste cart providing a bin that is strong and easily attached to a waste container or cart.

18 Claims, 10 Drawing Sheets

INSERT FOR A ROLLOUT TYPE WASTE CONTAINER AND WASTE CONTAINER ASSEMBLY

This application claims the benefit of Provisional Application No. 60/418,382 filed on Oct. 15, 2002.

TECHNICAL FIELD AND BACKGROUND OF THE INVENTION

This invention relates to an insert bin for use with a rollout type waste container or cart. In the waste industry, insert bins are customarily used by waste haulers to reduce the interior volume of rollout waste containers, which likewise limits the volume of refuse or recyclable material that a customer may deposit in the container in between waste collection pick-ups by the waste hauler.

Although alternative methods and devices exist to reduce the volume of refuse collected by waste haulers, such methods and devices are often cost-prohibitive for waste haulers to use. For example, while a waste hauler could elect to purchase and distribute waste carts with 20 gallon interiors in response to a governmental regulation requiring that a 35 gallon interior be reduced by 15 gallons, such a purchase would be impractical if the service area of the waste hauler extended across a district not subject to the 20 gallon restriction. Under such circumstances, the waste hauler would end up also having to purchase separate equipment for lifting and emptying the 20-gallon waste carts or else have to resort to an alternative means of reducing the interior volume of those waste carts distributed in those districts subject to the 20 gallon restriction.

While insert bins are currently available in the marketplace, the bins are inadequate because they use mechanical fasteners to retain the bin in place within respective waste carts. Such mechanical fasteners include rivets, push pins, clips and/or nut-and-bolt assemblies Other insert bins do not require mechanical fasteners, but are instead press-fit in place within respective waste carts. Such an insert bin relies solely on the resulting vacuum created between the walls of the bin and the waste cart to maintain the bin within the interior of the cart.

Regardless of whether mechanical fasteners or press-fitting is employed, prior art bins often fail in the field. The grippers on waste hauling trucks exert an extreme amount of force on a waste cart as the grippers lift the cart to dump its contents into the truck. This force distorts both the walls of the bin and the shape of the waste cart. Because the shape of the insert bin is not distorted to the same degree as the surrounding waste cart, pressure is concentrated on the mechanical fasteners that connect the insert bin to the waste cart. This pressure shears many of the fasteners into two pieces; in other cases, it pulls the fastener components apart.

For those insert bins that are press fit in place within the interiors of waste carts, the distortion the waste cart suffers during the waste collection process can cause separation between the waste cart and the insert bin, which in turn breaks the vacuum and allows the insert bin to slide out of the interior as refuse is being emptied into the truck. Furthermore, the waste cart and insert bin usually differ from one another with respect to the manufacturing processes, wall thicknesses or materials used—any one of these differences will cause a differential in shrinkage or expansion of the insert bin and waste cart when they are exposed to hot or cold temperatures. This differential can nullify the press fit and cause the insert bin to separate from and ultimately slide out of the waste cart.

The present invention overcomes the disadvantages of the prior art by providing an insert bin that is held in place within the interior of a waste cart without the use of separate mechanical components or a press fit. The insert bin instead takes advantage of a component that already exists on a waste cart for another purpose—the lift bar. The lift bar permits trucks equipped with specific types of gripping arms to grasp the bar, and lift and empty the waste container. In addition to performing this function, the lift bar of the waste cart is utilized in the present invention to lock the insert bin in position within the interior of the waste cart in a manner that minimizes vertical motion of the bin when the waste cart is turned upside down. Securing the insert bin within the waste cart in this manner also prevents any liquid or moisture becoming trapped between the insert bin and waste cart.

SUMMARY OF THE INVENTION

Therefore, it is an object of the present invention to provide an insert bin for a waste container that reduces the interior volume of the waste container.

It is another object of the present invention to provide an insert bin that can be positioned and held in place within the refuse compartment of a waste container using preexisting components of the waste container.

It is another object of the present invention to provide an insert bin for a waste container that may be quickly and easily installed within and removed from the interior of the waste container, and which is not easily removed by accident or during normal use of the waste container.

It is another object of the present invention to provide an insert bin for a waste container strong enough to be connected to a waste container and withstand the environmental stressors and forces to which the waste container is typically subjected during the process of emptying refuse or recyclables from the container.

These and other objects of the present invention are achieved in the preferred embodiments disclosed below by providing an insert bin for use with a rollout type waste container or cart. The insert bin includes spaced-apart forward and rear walls connected to a pair of spaced-apart sidewalls, and a floor connected to the forward, rear, and sidewalls. The insert bin is sized to fit inside a selected waste container, wherein an inwardly-directed ledge structure has a pair of spaced-apart lateral walls formed in the forward wall, and separated by a horizontal distance.

According to another preferred embodiment of the invention, the insert bin includes means for receiving a lock bar of a pre-selected length carried by the waste container so as to retain the insert bin in the waste container.

According to another preferred embodiment of the invention, the means for receiving a lock bar includes first and second housings defined by the forward wall and positioned adjacent respective ones of the lateral walls of the ledge structure.

According to another preferred embodiment of the invention, the means for receiving a lock bar includes an opening formed through each of the lateral walls of the ledge structure, the openings being aligned with each other.

According to another preferred embodiment of the invention, the forward wall has a height measured in a vertical direction substantially equal to that of the rear wall.

According to another preferred embodiment of the invention, the forward wall has a height measured in a vertical direction substantially greater than that of the rear wall.

According to another preferred embodiment of the invention, the forward wall, the rear wall, and the sidewalls terminate in an upper edge, so as to form a continuous rim.

According to another preferred embodiment of the invention, the continuous rim forms a top return flange.

According to another preferred embodiment of the invention, the forward wall, the rear wall, the floor, and the sidewalls come together to form four lower corners, at least one of the lower corners includes a recessed relief area for providing enhanced stability and strength.

According to another preferred embodiment of the invention, the recessed relief area is shaped to conform to an interior wall of a waste cart, permitting the insert bin to be nested within the waste container.

According to another preferred embodiment of the invention, the ledge structure defines a shoulder which extends into the interior of the insert bin, wherein the shoulder is an inwardly-directed shape which permits the ledge structure of the insert bin to be superposed upon a complementary ledge structure of a waste container.

According to another preferred embodiment of the invention, the insert bin is formed from a material selected from the group consisting of polyethylene and polypropylene.

According to another preferred embodiment of the invention, each of the housings includes a laterally extending recess formed in the forward wall, the recess extending between the lateral wall and an end surface which is offset from the lateral wall, the recess having a cross-sectional shape complimentary to that of the lock bar.

According to another preferred embodiment of the invention, the first housing has a first length measured between the lateral wall and the end surface, and the second housing has a second length measured between the lateral wall and the end surface, the first length being greater than the second length.

According to another preferred embodiment of the invention, the pre-selected length of the lock bar is less than the combined length of the horizontal distance separating the lateral walls and the first length of the first housing.

According to another preferred embodiment of the invention, a modified waste container includes spaced-apart forward and rearwalls connected to a pair of spaced-apart sidewalls, and a floor connected to said forward, rear, and sidewalls; an inwardly-directed ledge structure having a pair of spaced-apart lateral walls formed in said forward wall, and separated by a first horizontal distance, each of the lateral walls having an opening formed therethrough for receiving a lock bar; a lock bar extending between the lateral walls and through the openings; and means for retaining the lock bar in the openings.

According to another preferred embodiment of the invention, the means for retaining the lock bar includes at least one protruding fastener connected to the lock bar, the fastener limiting the lateral movement of the lock bar.

According to another preferred embodiment of the invention, the inwardly-extending ledge structure is shaped to receive a ledge structure on a forward wall of an insert bin.

According to another preferred embodiment of the invention, a waste container assembly includes a waste container including spaced-apart forward and rear walls connected to a pair of spaced-apart sidewalls, and a floor connected to said forward, rear, and sidewalls; an inwardly-directed ledge structure having a pair of spaced-apart lateral walls formed in the forward wall, and separated by a first horizontal distance, each of the lateral walls having an opening formed therethrough. An insert bin including spaced-apart forward and rearwalls connected to a pair of spaced-apart sidewalls, and a floor connected to the forward, rear, and sidewalls, the insert bin being sized to fit inside a selected waste container, wherein an inwardly-directed ledge structure having a pair of spaced-apart lateral walls formed in the forward wall, and separated by a first horizontal distance; and a means for receiving a lock bar. A lock bar extending between the lateral walls of the waste container and through the openings, the lock bar being received in the means for receiving a lock bar, so as to retain the insert bin in the waste container.

According to another embodiment of the invention, a means for retaining the lock bar in the openings, wherein the means for retaining the lock bar includes at least one protruding fastener connected to the lock bar, the fastener limiting the lateral movement of the lock bar.

According to another preferred embodiment of the invention, the means for receiving a lock bar comprise first and second housings defined by the forward wall and positioned adjacent respective ones of the lateral walls of the ledge structure.

According to another preferred embodiment of the invention, the means for receiving a lock bar includes an opening formed through each of the lateral walls of the ledge structure, wherein opposite ends of the lock bar are received in the openings.

BRIEF DESCRIPTION OF THE DRAWINGS

Some of the objects of the invention are set forth above. Other objects and advantages of the invention will appear as the invention proceeds when taken in conjunction with the following drawings, in which.

DESCRIPTION OF THE PREFERRED EMBODIMENT AND BEST MODE

Figure 1:
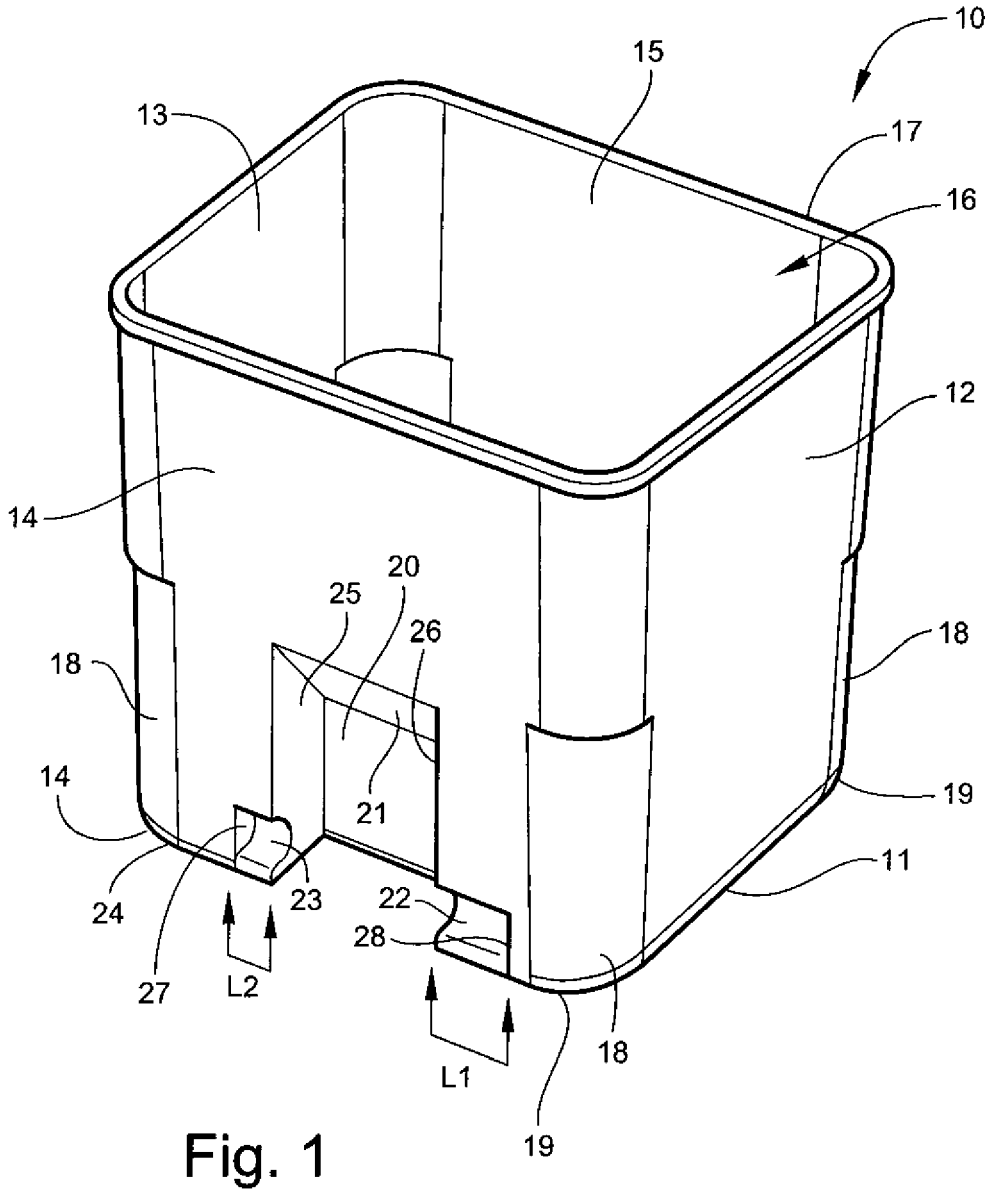
FIG. 1 is a perspective view of an insert bin according to one preferred embodiment of the invention.

Referring now specifically to the drawings, an insert bin shown generally at 10 according to one preferred embodiment of the invention is shown in FIG. 1. The insert bin includes a floor 11 upon which two opposing sidewalls 12 and 13, a forward wall 14, and an opposing rear wall 15 are formed, thereby defining an interior 16. As described more fully below, the interior 16 of the insert bin 10 functions as a reduced-volume refuse compartment when the insert bin 10 is positioned within the refuse compartment of a conventional rollout type waste container (hereafter referred to interchangeably as a "waste container" or "waste cart"). The forward wall 14, rear wall 15 and major opposing sidewalls 12 and 13 terminate in upper edges which form a continuous rim 17 defining a mouth of the insert bin 10.

Figure 2:
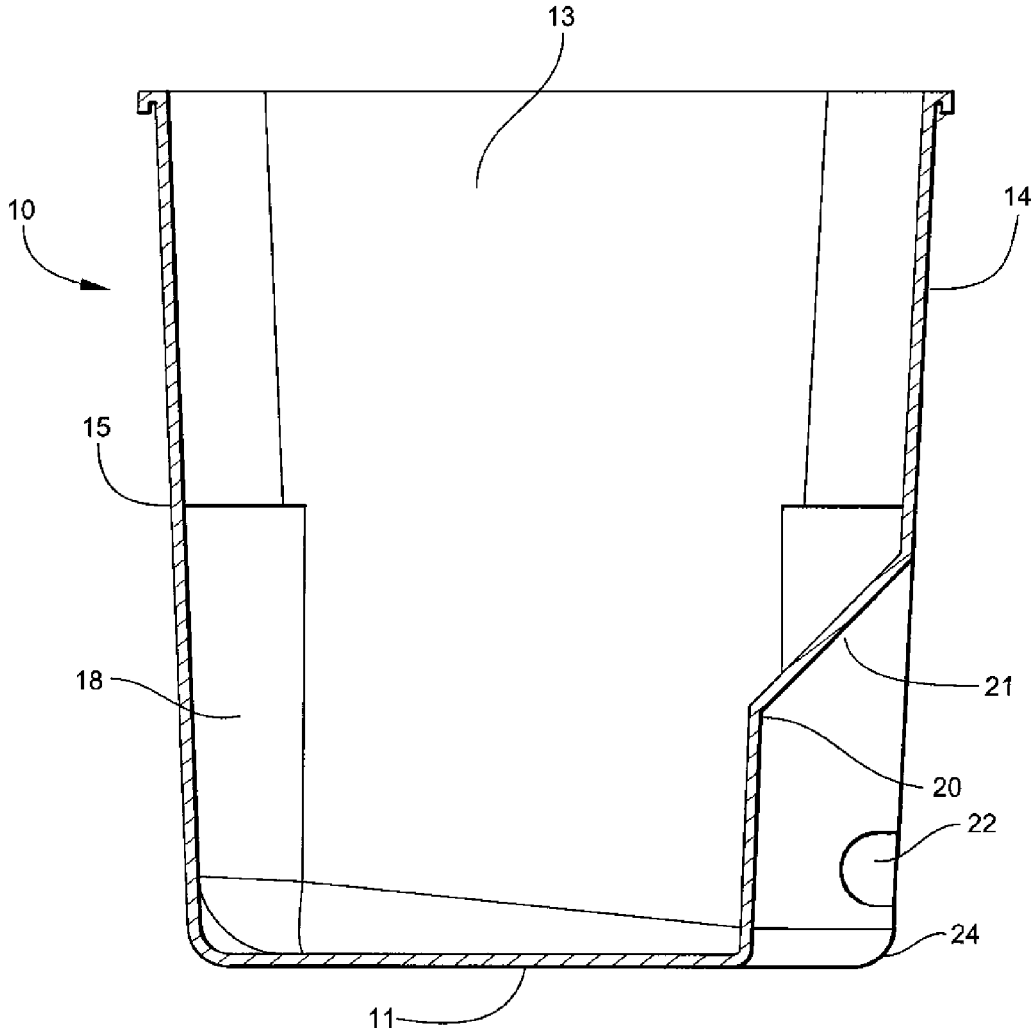
FIG. 2 is a cross sectional view of the insert bin of FIG. 1.

As is shown in FIG. 1, a recessed relief 18 area is formed in each of four lower corners 19 of the insert bin 10 adjacent the floor 11. The relief areas 18 provide enhanced stability and strength to the insert bin 10, which in turn enhances the ability of the insert bin 10 to return to its original shape after deforming in response to the bending and twisting forces typically applied to a waste cart by a hydraulic lift during the waste collection and removal process. The relief areas 18 are also shaped so that the exterior of the insert bin 10 conforms to the interior walls of the refuse compartment of a waste cart. As is described more fully below with reference to FIG. 4, the shape of the relief areas 18 permits the insert bin 10 to be nested within the interior of the waste cart. Referring again to FIG. 1, the forward wall 14 of the insert bin 10 also includes a ledge structure 20 defining a shoulder 21 which extends into the interior of the insert bin 10. The inwardly-directed shape of the shoulder 21 is also shown in FIG. 2, and permits the ledge structure 20 of the insert bin 10 to be superposed upon an identical ledge structure of a waste cart.

While it may be formed from any suitable material, the insert bin 10 is preferably formed from either high-density polyethylene or polypropylene. The insert bin 10 may also have any length, width, or height, depending upon the dimensions of the refuse compartment or other interior within which the bin 10 is intended to be positioned.

Referring again to FIG. 1, the insert bin 10 also includes first and second housings 22 and 23, each of which is defined by the forward wall 14 and positioned adjacent a respective one of two lateral walls 25 and 26 of the inwardly-directed ledge structure 20. In the illustrated example, the first and second housings 22 and 23 are positioned along the lower edge 24 of the insert bin 10, however the first and second housings 22 and 23 may spaced away from the lower edge 24 in a particular application, for example in an insert bin of larger capacity. The longitudinal axis of each of the first and second housings 22 and 23 preferably extends parallel to the lower edge 24 of the insert bin 10. The first housing 22 extends between the lateral wall 26 and an end surface 28, and the second housing 23 extends between the lateral wall 25 and an end surface 27. As is described in greater detail below with reference to FIG. 4, the shape of the relief areas 18, ledge structure 20 and first and second housings 22 and 23 permits the insert bin 10 to be superposed within the refuse compartment of a waste cart in a manner such that the exterior surfaces of the forward wall 14, rear wall 15 and opposing sidewalls 12 and 13 of the insert bin 10 nest within the interior walls of the waste cart.

Although the first and second housings 22 and 23 may have any suitable dimensions, as is shown in FIG. 1, the first housing 22 preferably has a length "L1" that is greater than the length "L2" of the second housing 23. As described below with reference to FIGS. 6 through 8, varying the lengths of the first and second housings 22 and 23 in this manner increases the relative speed and ease with which the insert bin 10 may be locked into place relative to the waste container.

Figure 3:
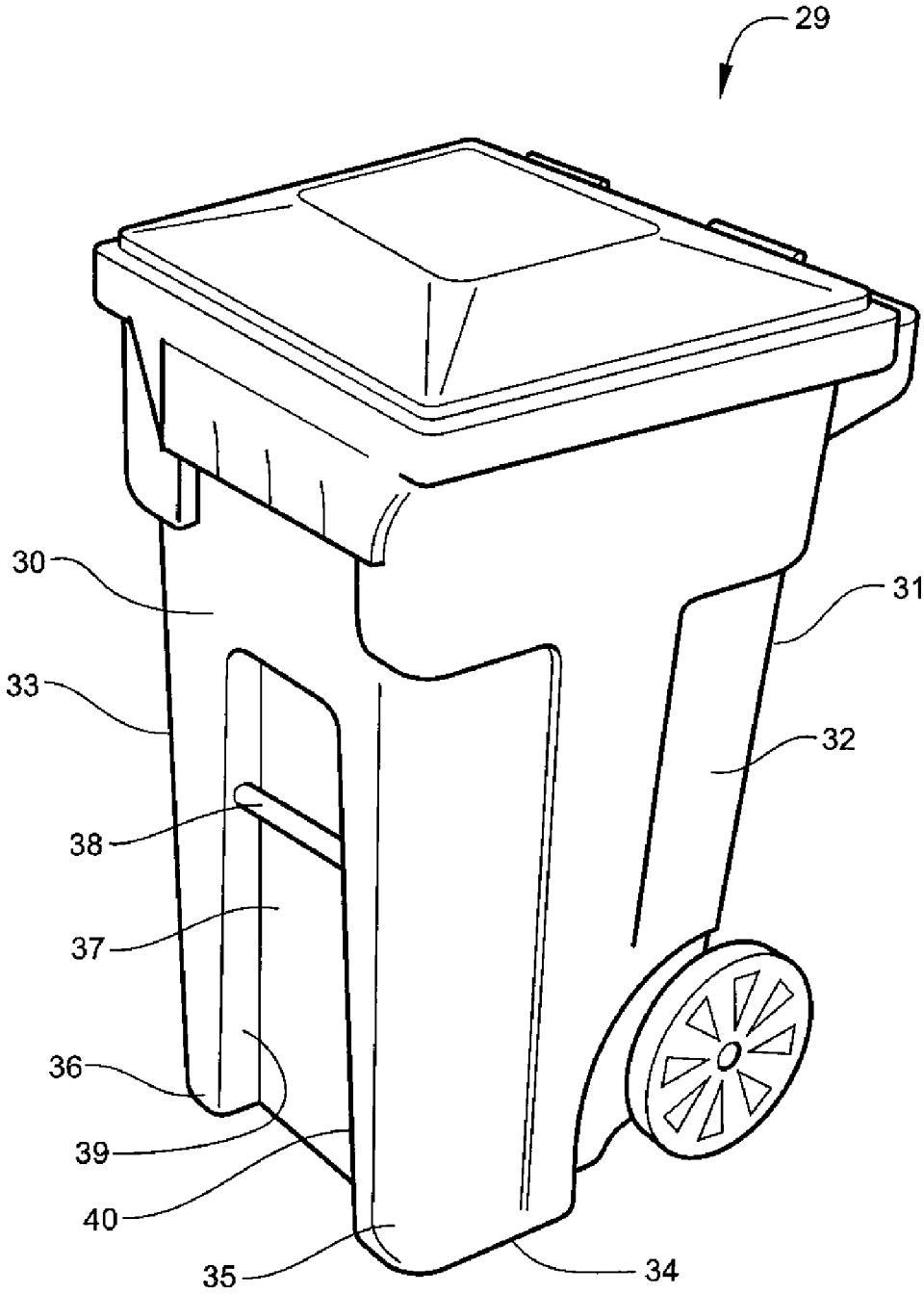
FIG. 3 is a perspective view of a modified rollout type waste container according to one preferred embodiment of the invention.

Referring now to FIG. 3, a modified waste cart shown generally at 29 is shown. The waste cart 29 is adapted for use with the insert bin 10 of the present invention. Although the waste cart 29 may be any suitable refuse storage device, the waste cart 29 is preferably one having features similar to those waste carts manufactured and sold by Schaefer Systems International, Inc. The wheeled waste cart 29 has forward 30, rear 31 and opposing sidewalls 32 and 33 formed on a floor 34. Relief areas 35 are formed on lower corners 36 of the waste cart 29 and shaped to conform to the shape of the relief areas 18 of the insert bin 10 described above with reference to FIG. 1. As is shown in FIG. 3, the forward wall 30 of the waste cart 29 also includes an inwardly-extending ledge 37 shaped to receive the ledge structure 20 on the forward wall 14 of the insert bin 10. The waste cart 29 also includes a lock bar 38, of a pre-selected length P, that extends between and interconnects the lateral walls 39 and 40 of the inwardly-extending edge 37. Like the lock bars of conventional rollout type waste containers, the lock bar 38 of the waste cart 29 shown in FIG. 3 is adapted for being received by a hydraulic lift unit for permitting the waste cart 29 to be lifted and overturned so that refuse may be emptied from the interior of the cart. However, unlike conventional lock bars, the lock bar 38 of the present invention is also used to maintain the insert bin 10 in a superposed position within the interior of the waste cart 29.

Figure 4:
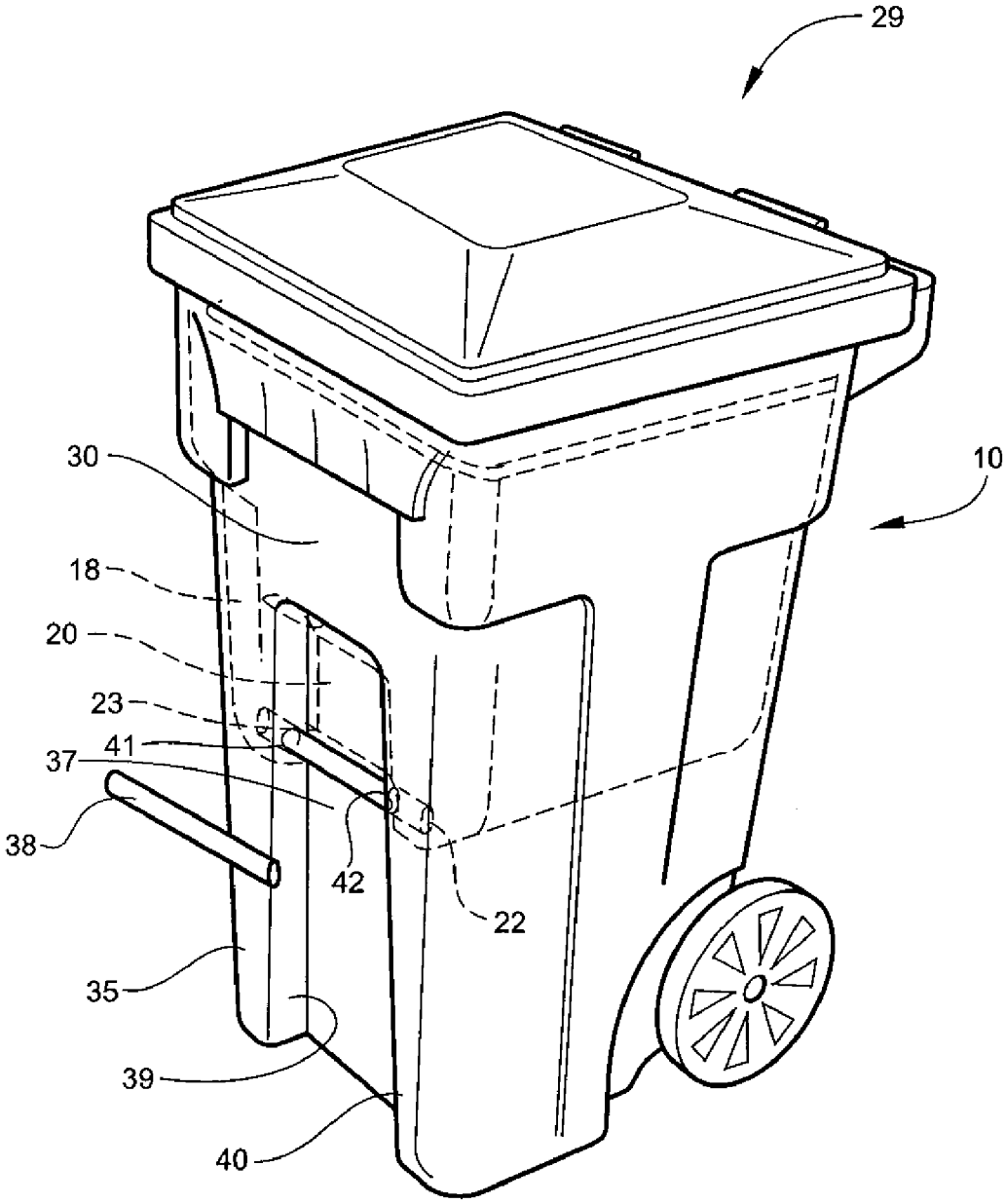
FIG. 4 is a perspective view of a waste container assembly according to the present invention.

Referring now to FIG. 4, the insert bin 10 is shown positioned within the interior of the waste cart 29 with the lock bar 38 ready to be locked in place. The complementary shapes of the ledge structures 20 and 37 and relief areas 18 and 35 of the respective insert bin 10 and waste cart 29 cause the exterior walls of the insert bin 10 to be positioned in closely-conforming relation to the interior walls of the waste cart 29. This in turn causes the ledge structure 20 on the insert bin 10 to be superposed on the ledge structure 37 of the forward wall 30 of the waste cart 29 so that the first and second housings 22 and 23 of the insert bin 10 are aligned with respective first and second openings 41 and 42 on the lateral walls 39 and 40 of the inwardly-extending ledge structure 37 of the waste cart 29.

Figure 5:
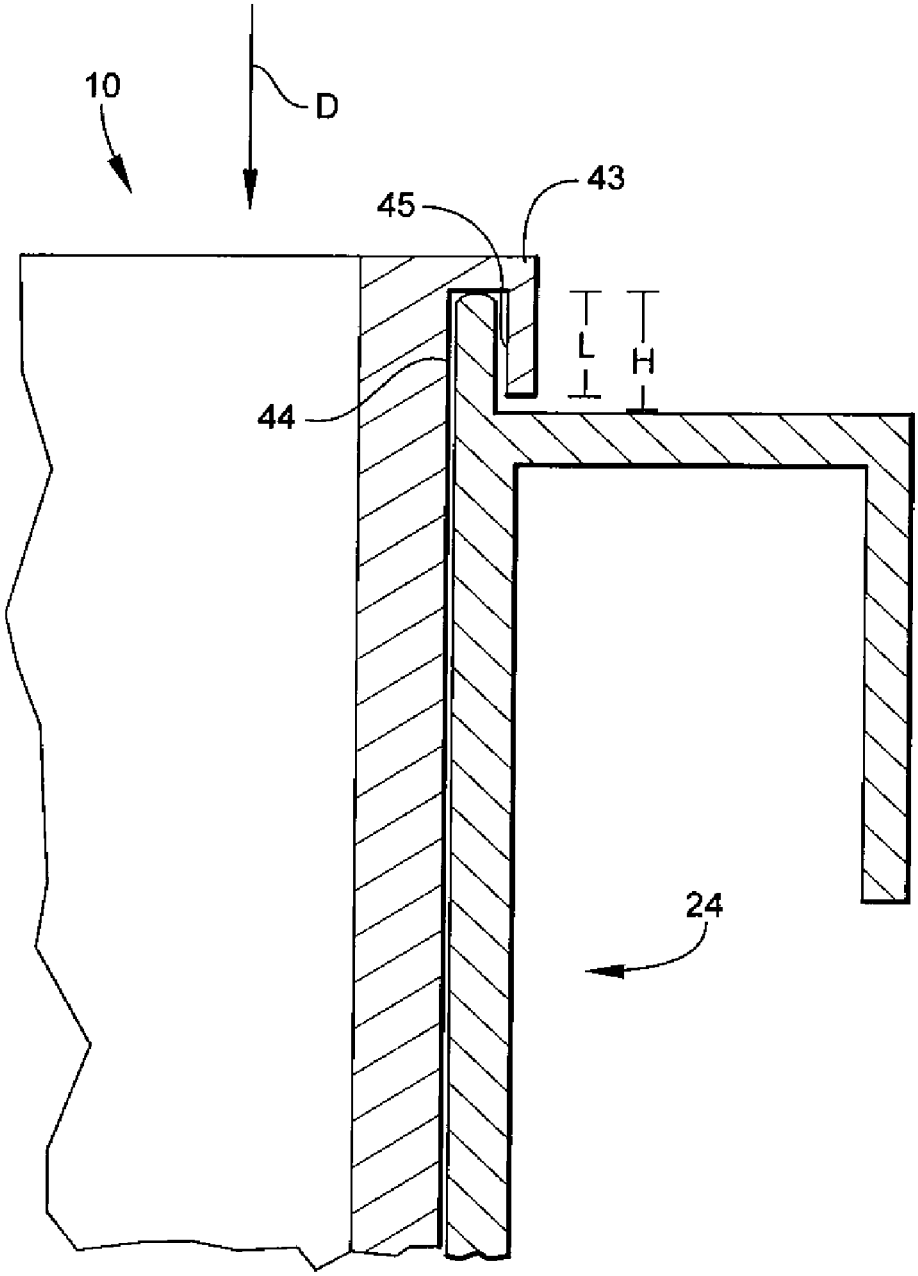
FIG. 5 is a partial cross-sectional view of the waste container assembly with the lid of the waste container removed.

Referring now to FIG. 5, the insert bin 10 is moved into place within the interior of the waste cart 29 by applying downward pressure to the insert bin 10 in the direction "D" shown until a top return flange 43 of the insert bin 10 is seated over a vertically-extending flange 44 of the waste cart 29. The vertical flange 44 extends around the mouth of the waste cart 29 and cooperates with a complementary-shaped groove 45 defined by the top return flange 43 on the insert bin 10 to seal off the interior of the waste cart 29 from debris that would otherwise get caught between the exterior sidewalls of the insert bin 10 and the interior sidewalls of the waste cart 29. As is shown in FIG. 5, the length "L" of the groove 45 is less than the height "H" of the vertical flange 44 of the waste cart 29. This allows the insert bin 10 to seat itself completely on the vertical flange 44, insuring the correct movement of the insert bin 10 allowed by the lock bar attachment method, which further inhibits passage of debris and liquid into the interior of the cart 29.

Figure 6:
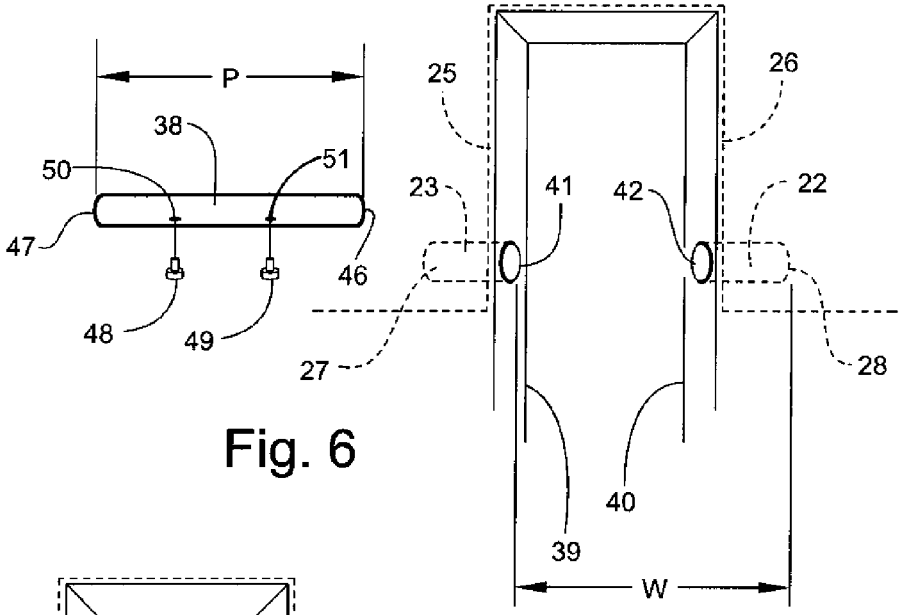
FIG. 6 is a partial schematic view of the front of the waste container assembly.
Figure 7:
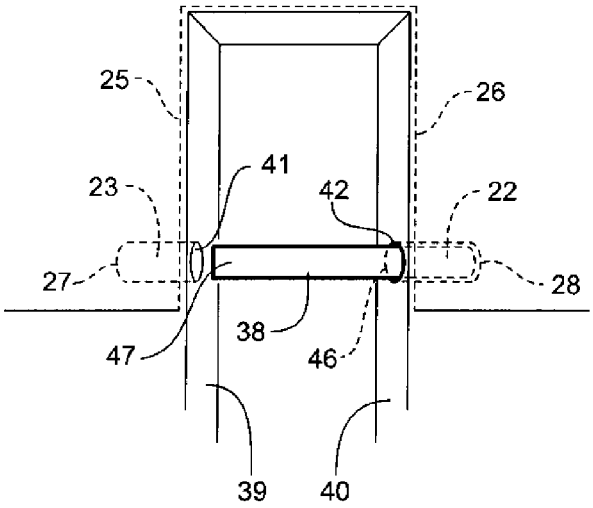
FIG. 7 is another partial schematic view of the front of the waste container assembly.

Referring now to FIG. 6, once the top return flange 43 is seated over the vertical flange 44 of the waste cart 29, the lock bar 38 is installed by inserting the first end 46 of the bar 38 through one of the openings 42 in the lateral wall 40 of the ledge structure 37 on the waste cart 29 in the direction "D" shown. As is shown in FIG. 7, inserting the first end 46 of the lock bar 38 into the deeper of the two housings 22 causes the second end 47 of the lock bar 38 to move past the opposite lateral wall 39 toward the center of the ledge structure 37. This in turn permits the second end 47 of the lock bar 38 to be inserted through the other opening 41 and into the second housing 23 in the insert bin 10. This is possible because the pre-selected length P of the lock bar 38 is shorter than the horizontal distance W between the end surface 28 of the first housing 22 and the lateral wall 41.

Figure 8:
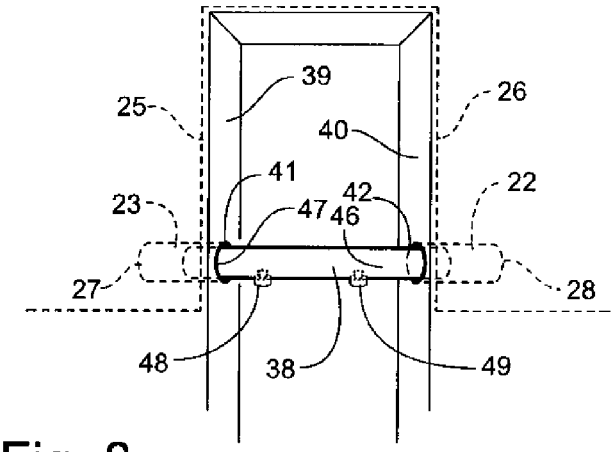
FIG. 8 is another partial schematic view of the front of the waste container assembly.
Figure 9:
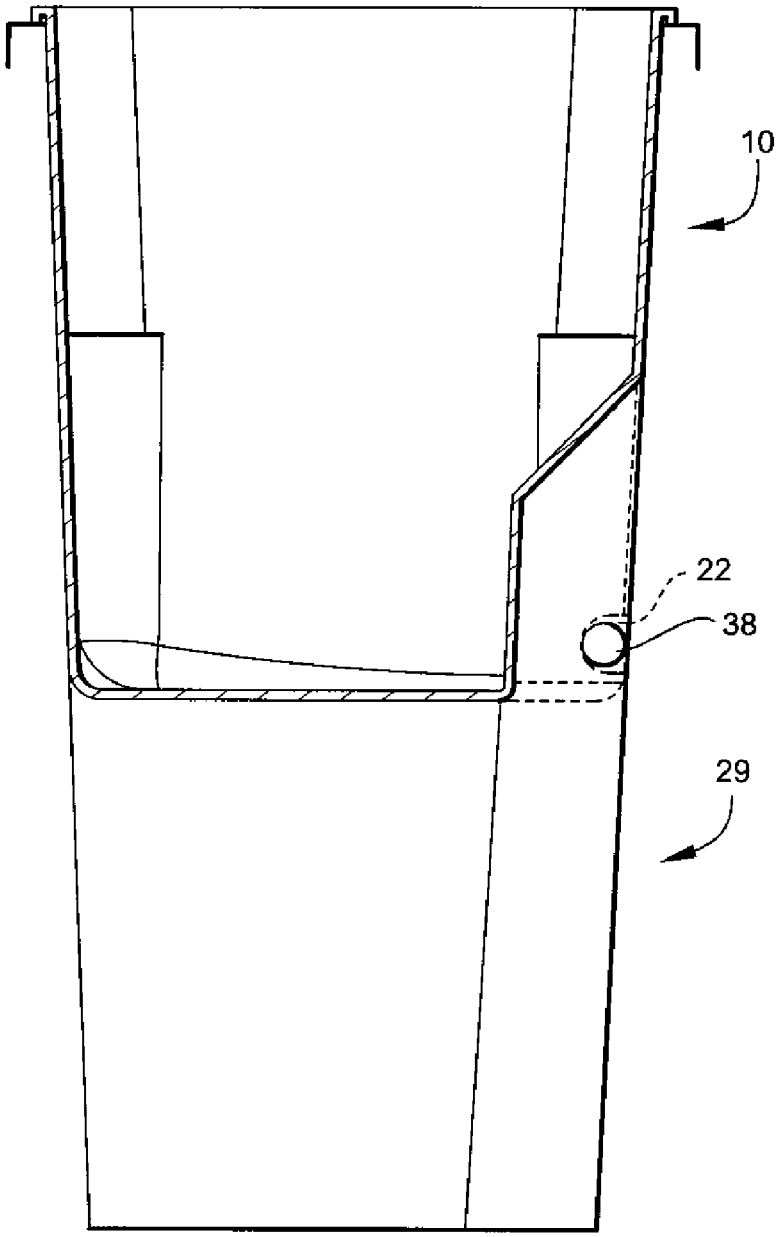
FIG. 9 is a cross-sectional side view of the waste container assembly with the lid of the waste container removed and the lift bar placed in a locked position.
Figure 10:
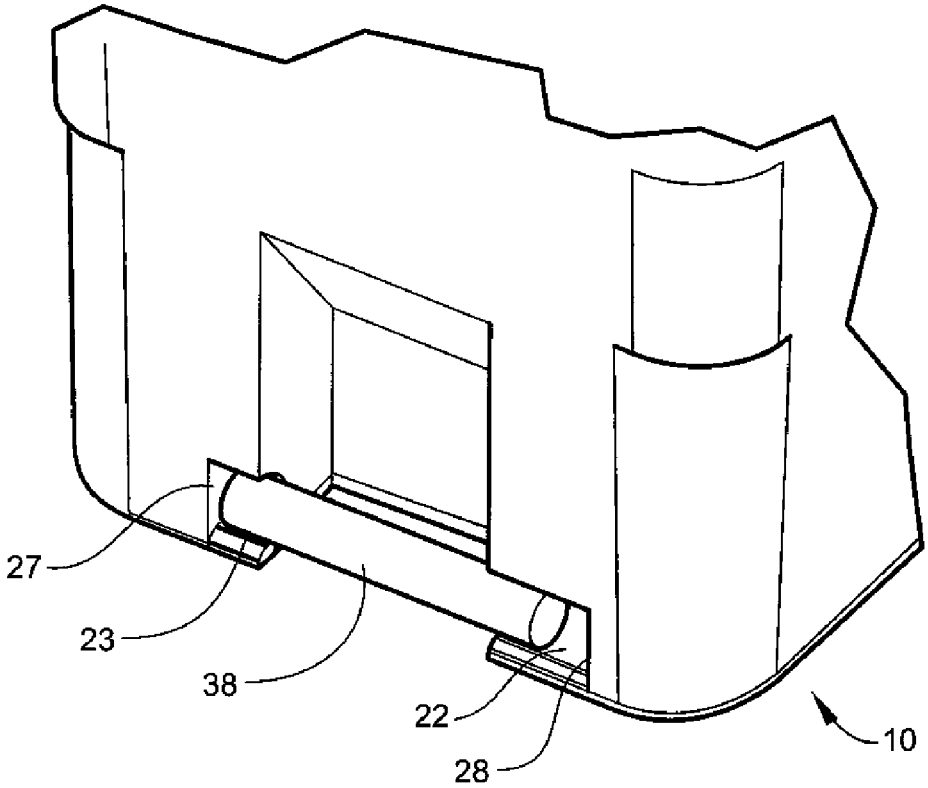
FIG. 10 is a partial perspective view of the insert bin and lock bar.

Referring now to FIG. 8, once the lock bar 38 is in place, a pair of fasteners such as pins 48 and 49 is inserted into holes 50 and 51 defined in the lock bar 38. Each pin 50 and 51 is positioned so that it is close enough to a respective one of the lateral walls 39 and 40 of the waste cart 29 to prevent the lock bar 38 from dislodging or otherwise being removed from its position relative to the waste cart 29 and insert bin 10. The orientation of the lock bar 38 and insert bin 10 relative to the waste cart 29 is shown in FIG. 9. FIG. 10 shows the lock bar 38 positioned within the first and second housings 22 and 23 with the waste container 29 removed to clarify the differences between the respective depths of the first and second housings 22 and 23.

Figure 11:
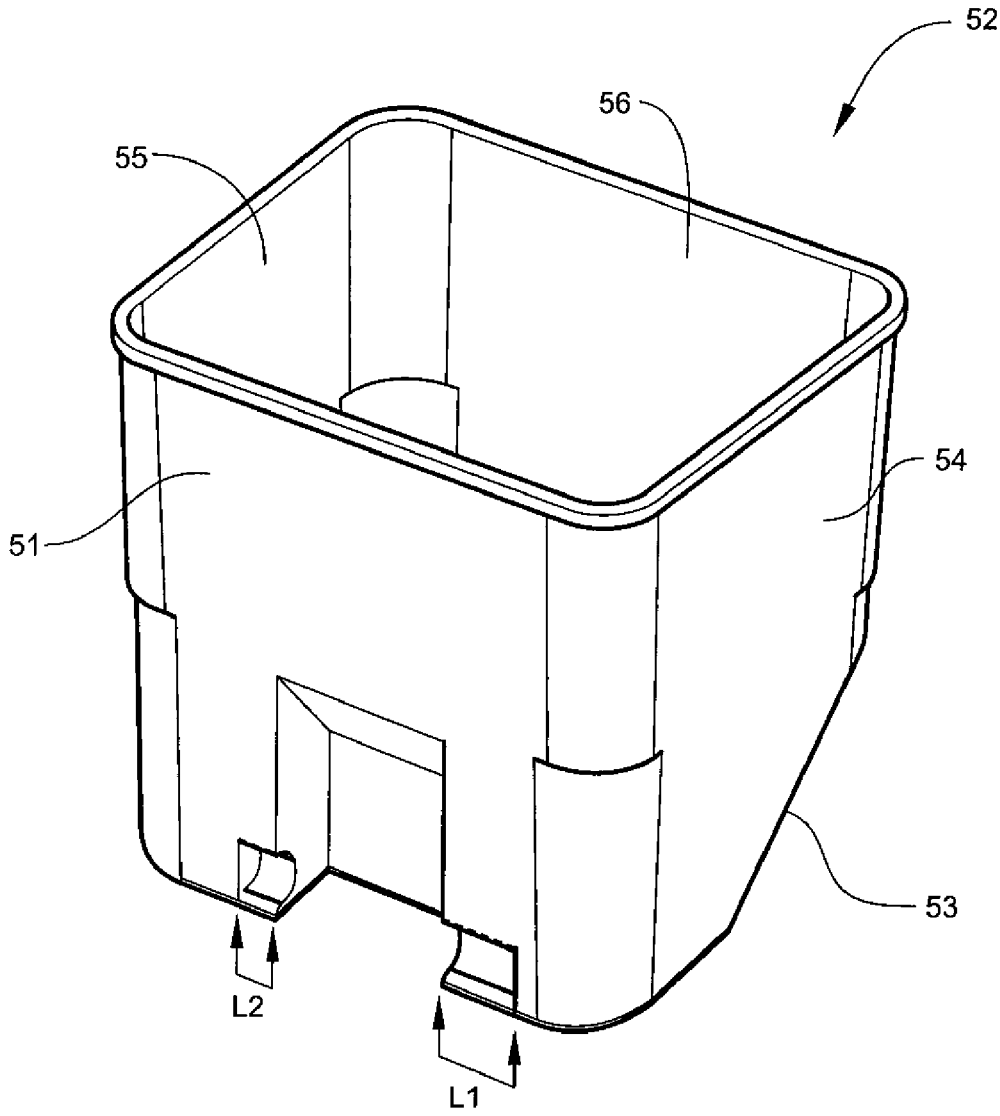
FIG. 11 is a schematic perspective view of an insert bin according to an alternative embodiment of the invention.

Referring now to FIG. 11, an insert bin shown generally at 52 according to another preferred embodiment of the invention is shown. With the exception of the shape of the floor 51 and the relative dimensions of the opposing sidewalls 54 and 55, rear wall 56 and forward wall 57, the insert bin 52 shown in FIG. 11 includes the same components and is formed from the same materials as the insert bin 10 described above with reference to FIGS. 1 through 10. However, the height of the forward wall 57 of the insert bin 52 in FIG. 11 is substantially greater than the height of the rear wall 56. This difference in height causes a portion of the floor 53 to extend diagonally between the forward 57 and rear walls 56, which in turn alters the shape and interior volume of the insert bin 52.

Figure 12:
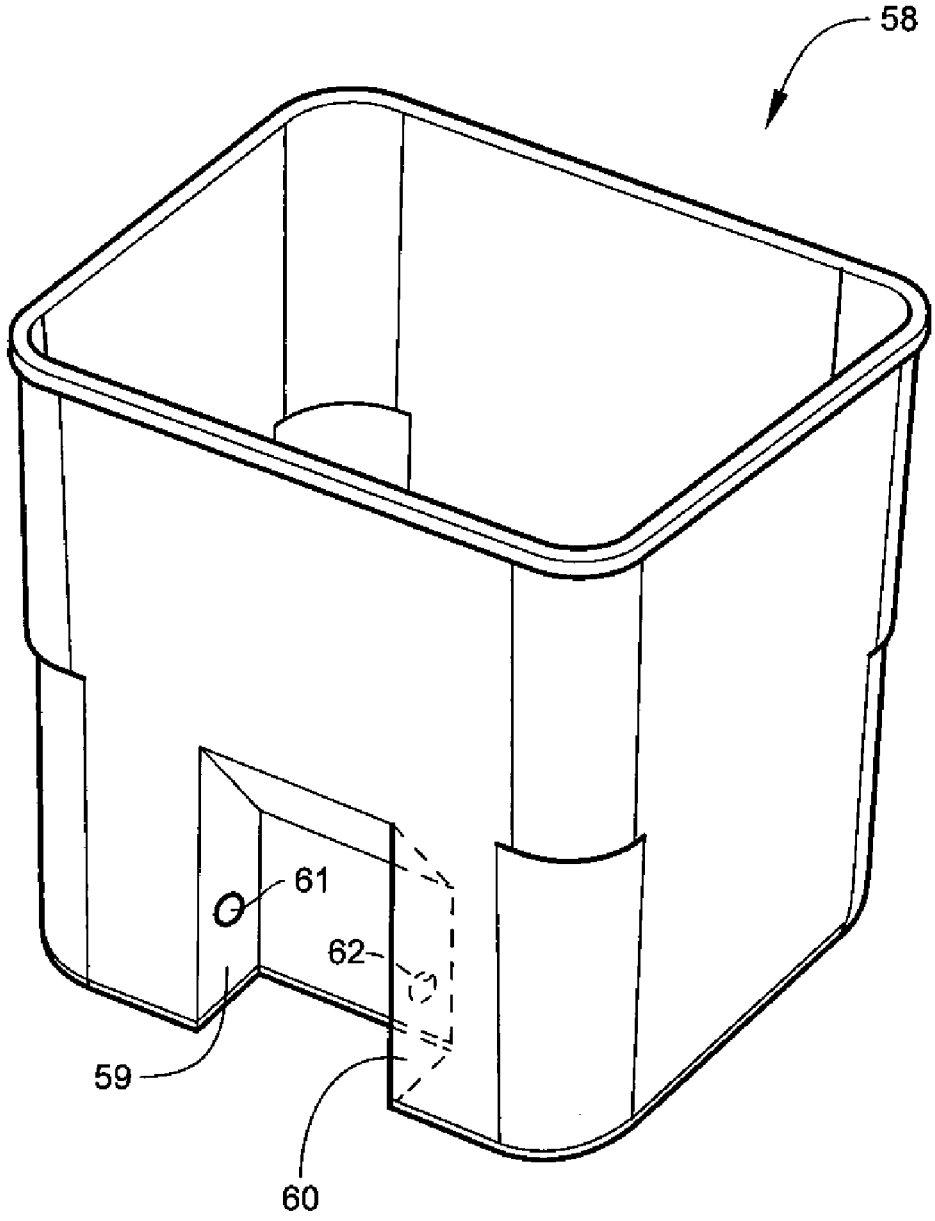
FIG. 12 is a schematic perspective view of an insert bin according to yet another alternative embodiment of the invention.

Referring now to FIG. 12, another preferred embodiment of the insert bin shown generally at 58 is shown. This insert bin 58 includes opposing lateral walls 59 and 60 that define respective openings 61 and 62 aligned with each other through which a lift bar is extended for maintaining the insert bin 58 in position relative to a waste cart. Like the insert bin 52 shown in FIG. 11, the insert bin 58 shown in FIG. 12 may be formed from any suitable materials and have any suitable dimensions.

An insert bin and waste cart assembly are described above. Various details of the invention may be changed without departing from its scope. Furthermore, the foregoing description of the preferred embodiments of the invention and the best mode for practicing the invention are provided for the purpose of illustration only and not for the purpose of limitation.

We claim:

1. An insert bin for use with a selected waste container of the type including a lock bar of a preselected length having an exterior portion disposed outside the waste container and exposed so as to be engaged by a lifting mechanism and at least one interior portion disposed inside the waste container, the insert bin being sized to fit inside the selected waste container and comprising:

(a) spaced-apart forward and rear walls, spaced-apart sidewalls, and a floor;

(b) an inwardly-directed first ledge structure having a pair of spaced-apart lateral walls formed in a selected one of said forward, rear, or side walls, and adapted to fit against a complementary inwardly-directed second ledge structure of the waste container, said lateral walls being separated by a first horizontal distance and facing each other; and (c) support means for receiving a said at least one interior portion of lock bar as to retain said insert bin in said waste container.

2. The insert bin according to claim 1, wherein said support means comprise first and second housings defined by said selected wall and positioned adjacent respective ones of said lateral walls of said first ledge structure.

3. The insert bin according to claim 1, wherein said support means comprise an opening formed through each of said lateral walls of said first ledge structure, said openings being aligned with each other.

4. The insert bin according to claim 1, wherein said forward wall has a height measured in a vertical direction substantially equal to that of said rear wall.

5. The insert bin according to claim 1, wherein said forward wall has a height measured in a vertical direction substantially greater than that of said rear wall.

6. The insert bin according to claim 1, wherein said forward wall, said rear wall, and said sidewalls terminate in an upper edge, so as to form a continuous rim.

7. The insert bin according to claim 6, wherein said continuous rim forms a top return flange.

8. The insert bin according to claim 1, wherein said forward wall, said rear wall, said floor, and the sidewalls come together to form four lower corners, at least one of said lower corners comprising a recessed relief area for providing enhanced stability and strength.

9. The insert bin according to claim 8, wherein the recessed relief area is shaped to conform to an interior wall of a waste container, permitting said insert bin to be nested within said waste container.

10. The insert bin according to claim 1, wherein the first ledge structure defines a shoulder which extends into the interior of the insert bin, wherein said shoulder is an inwardly-directed shape which permits said first ledge structure of said insert bin to be superposed upon the complementary second ledge structure of the waste container.

11. The insert bin according to claim 1, wherein the insert bin is formed from a material selected from the group consisting of polyethylene and polypropylene.

12. The insert bin according to claim 2, wherein each of said housings comprises a laterally extending recess formed in said selected wall, said recess extending between said lateral wall and an end surface which is offset from said lateral wall, said recess having a cross-sectional shape complimentary to that of said lock bar.

13. The insert bin according to claim 12, wherein said first housing has a first length measured between said lateral wall and said end surface, and said second housing has a second length measured between said lateral wall and said end surface, said first length being greater than said second length.

14. The insert bin according to claim 13, wherein said pro-selected length of said lock bar is less than the combined length of said first horizontal distance separating said lateral walls and said first length of said first housing.

15. A waste container assembly, comprising:

(a) a waste container comprising:

(i) spaced-apart forward and rear walls connected to a pair of spaced-apart sidewalls, and a floor connected to said forward, rear, and sidewalls;

(ii) an inwardly-directed ledge having a pair of spaced-apart lateral walls formed in said forward wall, each of said lateral walls having an opening formed therethrough;

(b) An insert bin disposed in said waste container, said insert bin comprising:

(i) spaced-apart forward and rear walls connected to a pair of spaced-apart sidewalls, and a floor connected to said forward, rear, and sidewalls, said insert bin being sized to fit inside said waste container, wherein an inwardly-directed ledge structure having a pair of spaced-apart lateral walls is formed in said forward wall, said ledge structure of said insert bin disposed in superposed relationship with said ledge of said waste container; and (ii) means for receiving a lock bar; and (c) a lock bar extending between said lateral walls of said waste container and through said openings, said lock bar being received in said means for receiving a lock bar, so as to retain said insert bin in said waste container.

16. The waste container assembly according to claim 15, further comprising a means for retaining said lock bar in said openings.

17. The waste container assembly according to claim 15, wherein said means for receiving a lock bar comprise first and second housings defined by said forward wall and positioned adjacent respective ones of said lateral walls of said ledge structure.

18. The waste container assembly according to claim 15, wherein said means for receiving a lock bar comprise and opening formed through each of said lateral walls of said ledge structure of said insert, wherein opposite ends of said lock bar are received in said openings.

* * * * *

UNITED STATES PATENT AND TRADEMARK OFFICE

CERTIFICATE OF CORRECTION

PATENT NO. : 7,172,088 B2
APPLICATION NO. : 10/684297
DATED : February 6, 2007
INVENTOR(S) : Clinton McDade and Morris Marlow It is certified that error appears in the above-identified patent and that said Letters Patent is hereby corrected as shown below:

Column 7, line 55, after the word “mechanism” enter --,--.

Column 8, line 1, delete the word “a”.

Column 8, line 2, after the words “portion of” enter --said--.

Column 8, line 2, after the word “bar” enter --so--.

Column 8, line 54, delete “pro-selected” and enter --pre-selected--.

Column 10, line 10, delete “and” and enter --an--.

Signed and Sealed this

Third Day of April, 2007

JON W. DUDAS
*Director of the United States Patent and Trademark Office*